US005632800A

United States Patent [19]

Pal et al.

[11] Patent Number: 5,632,800

[45] Date of Patent: May 27, 1997

[54] ACCELERATED DECARBURIZATION OF FE-C METAL ALLOYS

[75] Inventors: Uday B. Pal, Needham; Donald R. Sadoway, Belmont, both of Mass.

[73] Assignee: Massachusetts Institute of Technology, Cambridge, Mass.

[21] Appl. No.: 550,178

[22] Filed: Oct. 30, 1995

[51] Int. Cl.[6] ..... C21B 11/10

[52] U.S. Cl. ..... 75/10.35; 75/10.63; 75/433; 75/500

[58] Field of Search ..... 75/10.35, 10.63, 75/433, 500

[56] References Cited

U.S. PATENT DOCUMENTS 5,314,524 5/1994 Pal et al. ..... 75/10.35

*Primary Examiner*—Melvyn Andrews

*Attorney, Agent, or Firm*—Bruce F. Jacobs; Diderico Van Eyl

[57] ABSTRACT

A process for improving the rate of metal production and FeO utilization in a steelmaking process or a process combining iron-making and steelmaking in a single reactor that uses or generates Fe-C metal alloy droplets submerged in an FeO-containing slag. The process involves discharging a charge build-up (electron accumulation) in the slag at the slag-metal alloy interface by means of an electron conductor connected between the metal alloy droplets and a gas at a gas-slag interface, said gas having an oxygen partial pressure of at least about 0.01 atmosphere.

18 Claims, 1 Drawing Sheet

ACCELERATED DECARBURIZATION OF FE-C METAL ALLOYS

GOVERNMENT RIGHTS

The United States Government has rights in this invention by virtue of U.S. Department of Energy Grant No. DE-FC07-89ID12847.

BACKGROUND OF THE INVENTION

The rate of reduction of iron oxides dissolved in calcium-silicate slags by iron-carbon melts is an important factor in iron-making and steelmaking processes in general and, in particular, in in-bath smelting steelmaking processes. Several studies, for instance, have investigated how Fe-C metal alloy droplets affect the reduction rates of FeO in steelmaking processes, where the overall reaction is:

$$FeO\ (slag)+C\ (in\ metal)=Fe(1)+CO(g)$$

The reduction rates of FeO dissolved in $CaO—SiO_2—Al_2O_3$ slags by Fe-C metal alloy droplets have been experimentally determined, e.g. Sawada, Y., M. S. Thesis, Massachusetts Institute of Technology, Cambridge, Mass., 1990. In the study, Sawada found that there were two distinct regimes of reaction rates—one very fast and one very slow. The faster rate was identified as occurring during the initial 60 to 300 seconds of the reaction, depending on the slag composition and temperature. The faster reaction was found to be zeroeth order with respect to carbon in the Fe-C metal alloy droplet. The reaction rate in the second stage was very slow and the reaction virtually stopped when the carbon in the Fe-C metal alloy droplet was reduced to a particular level (commonly approximately 2 wt %). As a result, the reduction reaction fails to go to completion and leaves a slag containing FeO and Fe-C which creates a relatively high carbon intermediate.

The virtual stoppage of the reaction is believed to be due to the inability of electrons (e) (accumulated in the slag at the slag/Fe-C metal alloy interface in accordance with the reaction: $O^{2-}\rightarrow\underline{O}+2_e$), to migrate across the slag and be consumed by $Fe^{2+}$and $Fe^{3+}$ions in the reactions: $Fe^{2+}+2_e\rightarrow Fe$, and $2\ Fe^{3+}+2_e\rightarrow 2Fe^{2+}$. These cathodic reactions are believed to control the rate of the decarburization reaction. When the reaction $Fe^{2+}+2_e\rightarrow Fe$ and/or $Fe^{3+}2_e\rightarrow 2Fe^{2+}$ ceases, the oxidation of $O^{2-}$ per the reaction $O^{2-}\underline{O}+2_e$ is blocked. As a result, CO gas stops being formed according to the reaction: $\underline{C}+O\rightarrow CO$, Fe-C metal alloy droplets stop being decarburized, and the overall reaction (FeO (slag) +C (in Fe-C metal alloy)=Fe(l)+CO(g)) stops.

Consequently, conventional iron and steelmaking processes have required additional processing to convert the high carbon intermediate to metal. For instance, oxygen is typically blown through the molten slag. Such additional processing is, however, both time-consuming and adds to the expense of the process. Moreover, the additional processing produces excessively high oxygen levels in the slag and the metal, and also increases the volume of the slag by oxidizing the iron.

Conventional ironmaking and steelmaking technologies require that iron and steel be produced in two separate reactors. In iron-making processes, an ironmaking reactor (which has a reducing atmosphere) typically produces a solution of iron and carbon. In steelmaking processes, a steelmaking reactor (which typically has an oxidizing atmosphere) removes carbon from the iron and thereby produces steel. The need to use two (2) separate processes to make iron and then steel has several drawbacks. In addition to having the disadvantages of conventional steelmaking processes discussed above, the need to make iron and steel in two separate reactors increases the time and cost of production. Moreover, the making of iron and steel in two separate reactors often results in the loss of alloying elements as well as decreases in overall yield.

U.S. Pat. No. 5,314,524 discloses a process for improving the rate of metal production and FeO utilization in an iron and steel-making process wherein Fe-C metal alloy droplets are submerged in an FeO-containing slag and in which a charge build-up situated between the slag and the Fe-C metal alloy droplets (slag/Fe-C metal alloy interface) is discharged, preferably by means of an inert metallic conductor. The inert metallic conductor enables the accumulated electrons creating the charge build-up to migrate across the slag and be consumed by $Fe^{2+}$and $Fe^{3+}$in the slag according to the rate determining reactions: $Fe^{2+}+2_e\rightarrow Fe$ and $2Fe^{3+}+2_e\rightarrow 2Fe^{2+}$. Alternatively or in combination, the '524 patent discloses adding a transition-metal oxide to the FeO slag to increase the concentration of variable valence cations which consume the accumulated electrons at the slag/Fe-C metal alloy interface and to facilitate the formation of CO by the reaction $\underline{C}+\underline{O}\rightarrow CO$. The '524 process decarburizes metallic Fe-C metal alloy droplets submerged in an FeO-containing slag to less than about 0.05 wt % and eliminates the need to blow oxygen gas into the molten slag/metal system. The '524 process is carried out in a reactor in an inert atmosphere, which may be formed by introducing a suitable gas, i.e. argon, into the reactor. Typically, such an inert atmosphere has an oxygen partial pressure of less than about 0.001 atm.

Although the process of '524 is advantageous, the $Fe^{2+}+2_e\rightarrow Fe$ and $2Fe^{3+}2_e\rightarrow 2Fe^{2+}$reactions broad-scale application. Consequently, it is highly desirable to enhance the rate of removal of accumulated electrons (charge buildup) at the slag/Fe-C metal alloy interface(s) still further. Moreover, the need for a slag in '524 to contain large amounts of transition-metal oxides is expensive and not practical. It would thus be desirable to reduce these amounts substantially.

Accordingly, it is an object of the present invention to increase the rate of decarburization and thereby the rate of the reduction of iron oxides taking place in a FeO-containing slag.

Another object is to substantially reduce the amount of FeO and transition-metal oxides utilized.

A still further object is to produce iron and steel in a single reactor in a single continuous process.

SUMMARY OF THE INVENTION

The present invention is directed to a process for improving the rate of metal production and FeO utilization which contains Fe-C metal alloy droplets submerged in an FeO-containing slag in which a charge build-up occurs in the slag at the slag/Fe-C metal alloy interface and the charge build-up is discharged by means of an electron conductor connected between the metal alloy droplets and a gas at a gas-slag interface, where the gas has an oxygen partial pressure of at least about 0.01 atmosphere. Preferably, an FeO-containing slag containing less than about 10 wt % FeO, more preferably less than about 5 wt % FeO, is used. Also preferably, a slag containing less than 10 wt %, more preferably less than 5 wt % transition-metal oxides is used.

DESCRIPTION OF PREFERRED EMBODIMENTS

Figure 1:
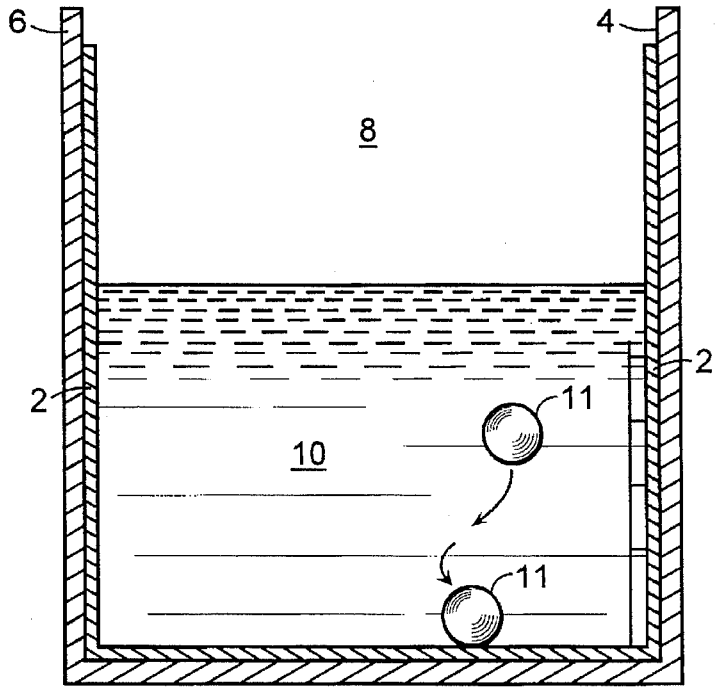
FIG. 1 is a cross section of a side view of a single chamber reactor for decarburizing Fe-C metal alloy droplets, e.g. in a steelmaking process.

The present invention is directed to a process for improving the rate of metal production and FeO utilization which contains Fe-C metal alloy droplets submerged in an FeO-containing slag in which a charge build-up occurs in the slag at the slag/Fe-C metal alloy interface and the charge build-up is discharged by means of an electron conductor connected between the Fe-C metal alloy droplets and a gas at a gas-slag interface, where the gas has an oxygen partial pressure of at least about 0.01 atmosphere. Preferably, the process uses an FeO-containing slag containing less than about 10 wt % FeO and less than about 10 wt % transition-metal oxides. More preferably the process uses less than about 5 wt % FeO and less than about 5 wt % transition-metal oxides.

As used in this application, the phrase "slag/Fe-C metal alloy interface" refers to the regions where the charge-buildup occurs between the FeO-containing slag and the Fe-C metal alloy droplets submerged in the FeO-containing slag.

As is used in this application, the phrase "gas-slag interface" refers to a region between a slag and an oxidizing atmosphere where oxygen ions are formed according to $O+2_e \rightarrow O^{2-}$ which discharge the charge build-up. The gas-slag interface may be above the FeO-containing slag in which the charge-buildup occurs or it may be above a second slag which may or may not contain FeO.

The oxidizing atmosphere of the present invention is a gas containing a sufficient amount of oxygen gas so that oxygen ions easily form when electrons are present. Preferably, the oxidizing atmosphere has an oxygen partial pressure (a measure of the oxygen content and thus the capacity to form $O^{2-}$ ions) of at least about 0.01 atm, more preferably at least about 0.1 atm, and still more preferably in the range from about 0.21 to about 1 atm.

The oxidizing atmosphere is formed by introducing an oxygen-containing gas in an amount sufficient to create the required oxygen partial pressure. The oxidizing atmosphere may be formed in an open environment where oxygen is continually introduced over a slag (since the gas escapes into the surrounding atmosphere). Alternatively, the oxygen-containing gas may be formed by periodically introducing an oxygen-containing gas over a reactor in a closed environment (where the gas does not escape).

The oxidizing atmosphere is preferably formed directly above a slag in a reactor, i.e. any vessel which is suitable for steel-making or ironmaking, and any slag contained in the chamber must be ionically conductive so that $O^{2-}$ can migrate in the slag. Preferably, the slag is electronically conductive. This may be accomplished by the addition of a transition-metal oxide. The composition of the slag may vary, and also FeO and Fe-C may be added to the slag depending on the role of the chamber in a particular application.

The oxidizing atmosphere is physically connected to the slag/-Fe-C metal alloy droplets by means of an electron conductor. A suitable electron conductor may be in any form including a foil, a plate, a liner or coating disposed on the interior surface or portion thereof of the chamber, or a wire. The electron conductor may be selected from any suitable metal such as molybdenum, iridium, platinum, palladium and tungsten, as well as electronically conductive refractory ceramics such as lanthanum chromite.

As shown in FIG. 1, an electron conductor 2 is located on the interior surface 4 of a steelmaking chamber 6 which contains a slag 10. The electron conductor 2 extends beyond the slag 10 and into an oxidizing atmosphere 8 which is located above the slag 10. The electron conductor 2 is held in place by the weight of the slag 10. During the decarburization process the Fe-C metal alloy droplets contact the electron conductor 2. This design is preferred when the present invention is used in a steelmaking process alone.

Figure 2:
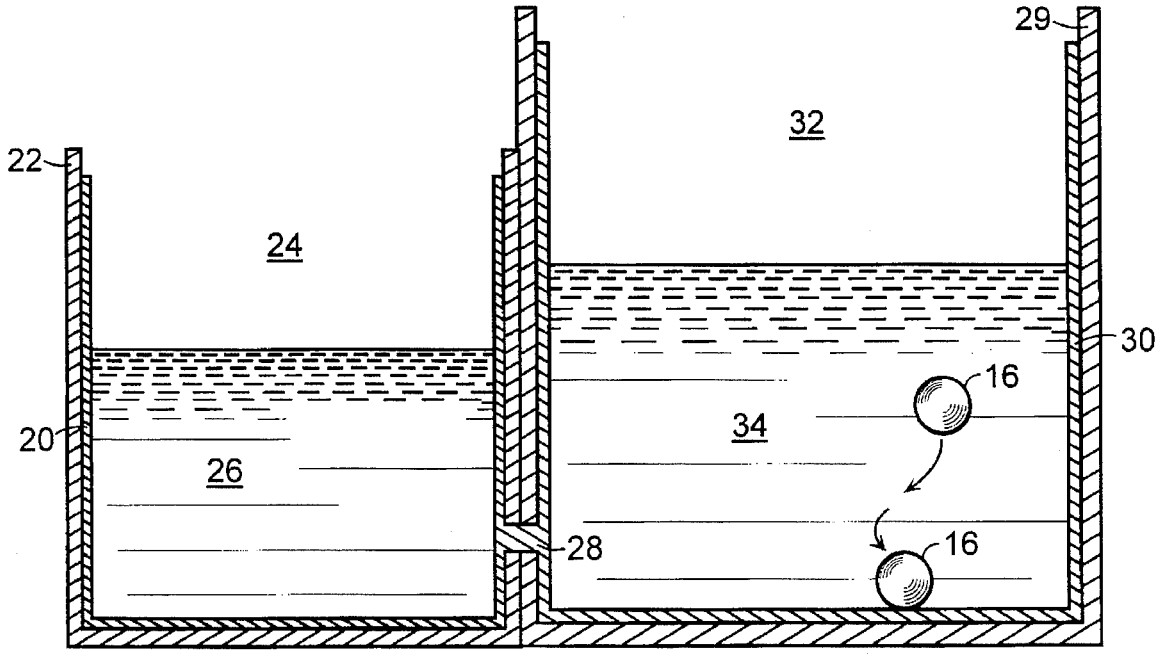
FIG. 2 is a cross section of a side view of a two chamber reactor for decarburizing Fe-C metal alloy droplets, e.g. in a combined iron and steelmaking process.

Alternatively, as shown in FIG. 2, especially for use in a combined ironmaking and steelmaking process, a first electron conductor 20 is in a first chamber 22 which contains an oxidizing atmosphere 24 above a first slag 26. The first electron conductor 20 is electrically connected at a connecting region 28 to a second electron conductor 30 of a second chamber 29 which has a reducing atmosphere 32 above a slag 34. Since the second electron conductor 30 is electrically connected to the first electron conductor 20, the second electron conductor 30 is in contact with the oxidizing atmosphere 24 in the first chamber 22.

The decarburization (carbon oxidation) occurs as follows:

$$\tfrac{1}{2}O_2(g) \rightarrow \underline{O}$$

$$\underline{C}+\underline{O} \rightarrow CO$$

where $\underline{C}$ and $\underline{O}$ are dissolved carbon and oxygen in the iron-carbon melt. Since the slag participates in the $\underline{C}+\underline{O} \rightarrow CO$ reaction, the reaction is preceded by the dissolution of oxygen ions from the slag into the iron-carbon melt through a reaction such as:

$$O^{2} \rightarrow \underline{O}+2e$$

Electrons continue to accumulate at the slag/Fe-C metal alloy interfaces, until the reaction stops (due to the inability of the electrons to migrate across the slag and be consumed by the $Fe^{2+}+2_e \rightarrow Fe$ and/or $2Fe^{3+}+2_e \rightarrow 2Fe^{2+}$). The charge build-up (electron accumulation) at the slag/Fe-C metal alloy interface is discharged through an electron conductor connected between the Fe-C metal alloy droplets and a gas at a gas-slag interface, where the gas has an oxygen partial pressure of at least about 0.01 atmosphere.

The FeO-containing slag is held in a reactor and the Fe-C metal alloy droplets are submerged in the slag so that the electrons accumulate at the slag/Fe-C metal alloy interface (not shown) which is located between the slag 10 (FIG. 1) or 34 (FIG. 2) and the Fe-C metal alloy droplet 11 (FIG. 1) or 16 (FIG. 2). An electron conductor connects the Fe-C metal alloy droplet to the slag-gas interface. This is accomplished in FIG. 1 by the electron conductor 2 being located partially below the FeO-containing slag 10 (where it contacts the metallic Fe-C metal alloy droplets) and partially in the oxidizing atmosphere 8 directly above the slag 10. In FIG. 2, the electron conductor 30 located below the FeO-containing slag 34 in the second chamber 29 is electrically connected to the electron conductor 20 in the chamber 22 which extends into the oxidizing atmosphere 24. As a result, when a charge build-up contacts an electron conductor in either FeO-containing slag, the excess electrons migrate along the electron conductor to the respective oxidizing atmospheres. The presence of the electrons in the oxidizing atmospheres 8 or 24 then enables oxygen ions to form at the gas-slag interface according to $O+2_e \rightarrow O^{2-}$ and the $O^{2-}$ ions migrate back to the site of another charge build-up between an FeO-containing slag and an Fe-C metal alloy droplet, thereby promoting the decarburization reaction $\underline{C}+\underline{O} \rightarrow CO$.

When the FeO-containing slag is located directly below an oxidizing atmosphere, as shown in FIG. 1, the $O^{2-}$ ions migrate directly through the FeO-containing slag. When the FeO-containing slag is located below a reducing atmosphere, as shown in FIG. 2, the $O^{2-}$ ions migrate into a slag 26 below the oxidizing atmosphere 24 and then through an opening (not shown) between the oxidizing chamber 22 and the reducing chamber 29 into the FeO-containing slag 34. Thus, Fe-C is produced in the reducing chamber and oxidized in both the reducing and oxidizing reactors. The size and shape of the opening are not critical provided that $O^{2-}$ ions are able to move through that opening.

A suitable slag for decarburizing Fe-C metal alloy droplets during steelmaking is any FeO-containing slag such as $CaO—SiO_2—MgO—FeO-Al_2O_3$. Due to the electrical properties of these slags, electron accumulation occurs at the slag/Fe-C metal alloy interface. The slags may also contain other additives that are not oxides such as S, P, C, etc. in varying amounts, where the combined amount of these additives is usually from about 0.01 to about 5 wt % The FeO-containing slag must be heated to a temperature sufficiently high to reduce the FeO in the slag and form Fe-C metal alloy droplets. The slag is generally heated to a temperature of about 1200 to 1700° C, more preferably to from about 1400 to 1600° C.

The ability of the oxidizing atmosphere to supply oxygen ions and drain the accumulation of excess electrons situated between the slag and the Fe-C metal alloy droplets substantially lowers the concentration of FeO and transition-metal oxides needed in the slag to completely decarburize the Fe-C metal alloy droplets. Preferably, less than about 10 wt % FeO is used and less than about 10 wt transition-metal oxides are used, depending on the amount of oxygen ions produced from the oxidizing atmosphere. More preferably, less than about 5 wt % FeO and less than about 5 wt % transition-metal oxides are used. The amount of oxygen ions produced will depend on factors such as the size of the melt and the decarburization rate.

The present invention is easily incorporated into conventional steelmaking or combined steelmaking and ironmaking processes. When the present invention is incorporated into a steelmaking process, for instance, the present invention may be carried out by adding a suitable electron conductor to the steelmaking chamber and a device suitable for forming a proper oxidizing atmosphere. When the present invention is used to make iron and steel in a single chamber, the iron-making chamber must be electrically connected to a second chamber surrounded by an oxidizing atmosphere as discussed above.

The present invention removes substantially all of the carbon from Fe-C metal alloy droplets submerged in an FeO-containing slag, preferably to less than about 1 wt %, more preferably to less than about 0.1 wt %, at a rate which is from about 50 to about 1,000% faster than the decarburization rates obtained by the process of U.S. Pat. No. 5,314,524. The present invention requires substantially less FeO and transition-metal oxide than '524 and reduces iron loss. Moreover, slag volume is minimized in the present invention because the slag increases in volume as the iron oxide content (concentration) increases (when the oxygen blow is carried out during a steelmaking process). Further, the oxygen content of the metal produced by the present invention is reduced due to the reduced concentration of iron oxide in the slag.

The present invention will now be described with reference to the following Examples. It is understood that these Examples are for illustrative purposes only and should not be deemed as limiting this invention. All parts and percents are by weight unless otherwise specified.

EXAMPLE 1

Experiments are performed in which an electron conductor (molybdenum foil) is placed in the interior of an alumina crucible such that the slag and the crucible are separated by the molybdenum foil. FIG. 1 is representative of the experimental setup.

In this experiment, a molybdenum foil (b 0.01mm thick) is placed in the crucible such that part of the foil extends above the slag into an oxidizing atmosphere. The oxidizing atmosphere is formed using appropriate gaseous mixtures such as $Ar/O_2$, $O_2/H_2$, $CO_2/CO$, such that oxygen partial pressure is greater than 0.1 atmospheres. A 2.02 g Fe-C (4.79% C, 0.0023% S) droplet is dropped in 110 g of an FeO slag (composed of from about 5–10 wt % FeO, 40–45% wt CaO, 35–40% $SiO_2$, and 10–15% $Al_2O_3$. When the Fe-C metal alloy droplet touches the side or the bottom of the crucible it contacts the electron conductor.

Type-D Experiment

In this experiment, the Type-C experiment is repeated, except that the electron conductor is not connected to a gaseous oxidizing atmosphere formed above the slag. Rather a reducing CO atmosphere is provided above the slag surface.

In both C and D experiments, the reactions proceed to almost 0% C. The rates for the Type-C experiments are faster by a factor of 10 or more than the rates of the Type-D experiments.

EXAMPLE 2

In this example, the production of iron and steel in a single reactor by the present invention is compared to the production of iron and steel by means of a conventional ironmaking and steelmaking process in two different reactors.

Type E Experiment

In this experiment, iron and steel are produced in a single reactor according to the present invention. FIG. 2 is representative of the experimental setup. A reducing atmosphere is formed above a first chamber by introducing a suitable gas, i.e. CO. A second chamber containing 5% FeO and transition-metal oxides is placed adjacent to the first chamber and various oxidizing atmospheres are formed over the second chamber as in Example 1. There is a metallic connection (electron conductor) between the two reactors below the slag level in each. In the first chamber, a suitable slag along with iron oxide and carbon in the form of coal or coke are used to reduce the iron oxide and form Fe-C metal alloy droplets, the carbon in the Fe-C metal alloy is then removed, and the Fe-C metal alloy is converted into steel. The second chamber serves to make an oxidizing atmosphere available to the first chamber by having the electron conductor partially extend above the slag into the oxidizing atmosphere in the second chamber. The Fe-C metal alloy droplets contact the electron conductor for complete decarburization.

When iron and steel are produced in the single reactor, the steel is produced at a faster rate than when iron and steel are made conventionally in two different reactors.

What is claimed is:

1. In a process for improving the rate of metal production and FeO utilization which contains Fe-C metal alloy droplets submerged in an FeO-containing slag in which a charge build-up occurs in the slag at slag/Fe-C metal alloy interfaces and the charge build-up is discharged by means of an electron conductor, the improvement comprising connecting the electron conductor between the Fe-C metal alloy droplets and a gas at a gas-slag interface, said gas having an oxygen partial pressure of at least about 0.01 atmosphere.

2. The process of claim 1, wherein the oxygen partial pressure is at least about 0.1 atmosphere.

3. The process of claim 1, wherein the oxygen partial pressure of about 0.21 atmosphere.

4. The process of claim 1, wherein the oxygen partial pressure is about 1 atmosphere.

5. The process of claim 1, where the FeO-containing slag is located in a chamber immediately below the gas-slag interface.

6. The process of claim 1, wherein the slag comprises $CaO—SiO_2—FeO-Al_2O_3$.

7. The process of claim 1 wherein the slag contains less than about 10 wt % FeO.

8. The process of claim 1 wherein the slag contains less than about 5 wt % FeO.

9. The process of claim 1, wherein the slag contains less than about 10 wt % transition-metal oxides.

10. The process of claim 1, wherein the slag contains less than about 5 wt % transition-metal oxides.

11. The process of claim 1, wherein the FeO-containing slag is located in a chamber immediately below a reducing atmosphere.

12. The process of claim 11, wherein the gas-slag interface is located above a second reactor containing a second slag and there is an electron conductor between the first reactor and the second reactor which permits $O^{2-}$ formed at the gas-slag interface to discharge the charge build-up at the slag/Fe-C metal alloy interface in the FeO-containing slag below the reducing atmosphere.

13. The process of claim 12, wherein the second chamber contains a slag.

14. A method for improving the rate of metal production and FeO utilization in a process that uses a first chamber containing Fe-C metal alloy droplets submerged in an FeO-containing slag and a reducing atmosphere covering the slag; and a second chamber containing a second slag and a gas-slag interface and an oxidizing atmosphere above said second slag; wherein the second chamber is located adjacent to the first chamber and is electrically connected to the first chamber by means of the electron conductor; and wherein a charge build-up occurs between the slag in the first chamber and the Fe-C metal alloy droplets in the first chamber, said method comprising the step of:

(a) contacting the charge build-up with an electron conductor that is connected from the slag in the first chamber to the gas-slag interface in the second chamber to discharge the charge buildup, said oxidizing atmosphere having an oxygen partial pressure of at least about 0.01 atmosphere.

15. The method of claim 14, wherein the gas-slag interface has an oxygen partial pressure of at least about 0.1 atmosphere.

16. The method of claim 14, wherein the gas-slag interface has an oxygen partial pressure of about 0.21 atmosphere.

17. The method of claim 14, wherein the gas-slag interface has an oxygen partial pressure of about 1 atmosphere.

18. The method of claim 14, wherein the FeO-containing slag contains less than about 5 wt % FeO and less than about 5 wt % transition-metal oxides.

* * * * *